US006758256B1

(12) United States Patent
Garcia

(10) Patent No.: US 6,758,256 B1
(45) Date of Patent: Jul. 6, 2004

(54) LOUVERED ARCH MECHANISM

(75) Inventor: Eduardo Garcia, Miami, FL (US)

(73) Assignee: Creative Arch Specialist, Inc., Miami, FL (US)

( * ) Notice: Subject to any disclaimer, the term of this patent is extended or adjusted under 35 U.S.C. 154(b) by 0 days.

(21) Appl. No.: 10/387,584

(22) Filed: Mar. 14, 2003

(51) Int. Cl.[7] ..... E06B 7/086
(52) U.S. Cl. ..... 160/134; 49/74.1; 49/87.1
(58) Field of Search ..... 160/134, 84.07, 160/168.1 V, 176.1 V, 177 V, 900; 49/74.1, 40, 77.1, 87.1, 41

(56) References Cited

U.S. PATENT DOCUMENTS 602,967 A * 4/1898 Wells ..... 160/134
1,447,189 A 3/1923 Simon
4,776,380 A * 10/1988 Lester ..... 160/134
6,029,733 A * 2/2000 Xue ..... 160/84.07
6,341,447 B1 * 1/2002 Jean ..... 49/74.1
6,390,172 B1 * 5/2002 Fleishman et al. .... 160/168.1 V

* cited by examiner

*Primary Examiner*—David Purol
(74) *Attorney, Agent, or Firm*—J. Sanchelima; A. Bordas

(57) ABSTRACT

A louver assembly for semi-circular, non-perfect or imperfect arch frame assemblies with louvers rotably mounted therein. A tensioning mechanism keeps the louvers taut between an arched frame member and a smaller anchorage frame member. An actuating mechanism is used to rotate the louvers upon the application of a predetermined force to a chain that coacts with teethed sprockets coupled with hooked clip members that removably hold the louvers. In this manner, the louvers are rotated between two extreme positions.

10 Claims, 5 Drawing Sheets

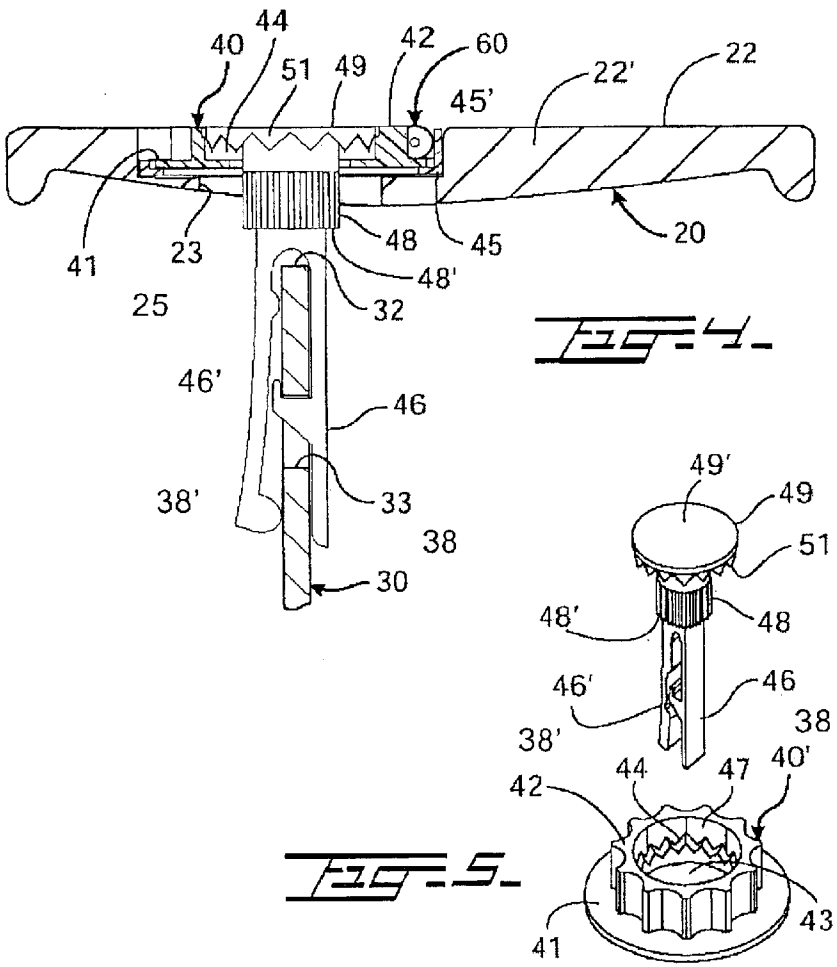
FIG. 4
FIG. 5
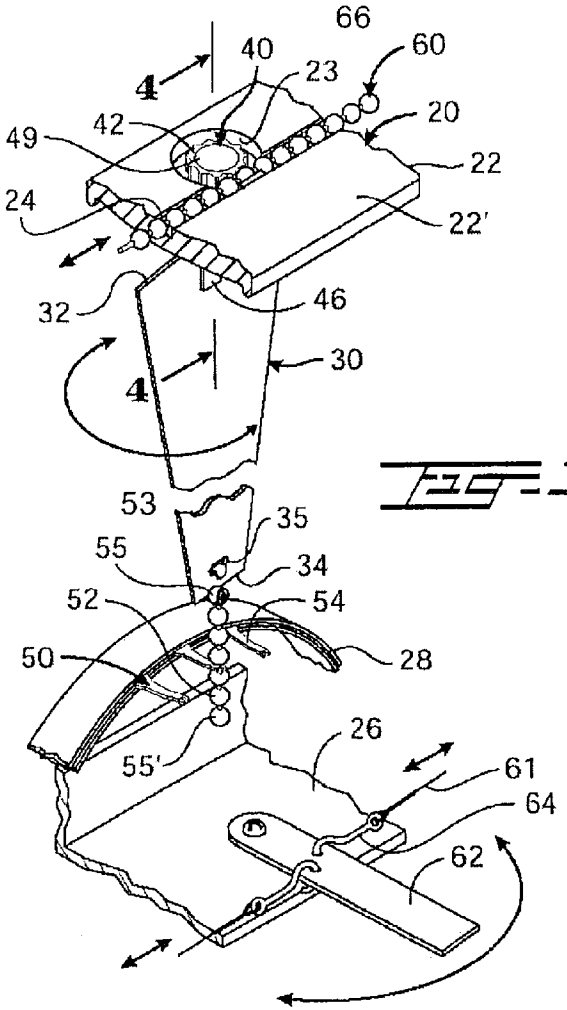
FIG. 3

LOUVERED ARCH MECHANISM

BACKGROUND OF THE INVENTION

1. Field of the Invention

The present invention relates to a louvered arch mechanism, and more particularly, to a louvered arch window that includes a mechanism for opening and closing blinds that are radially disposed with a common central point.

2. Description of the Related Art

Many designs for louvered arch mechanisms have been designed in the past. These mechanisms are used in arches that are typically positioned above doors and windows. None of them, however, has the blinds taut at one end while the other end (distal end) is actuated (rotated) in tandem with a common link. The blinds or louvers or slats are remotely rotated by a user. The actuating mechanism has the advantage of being substantially flush with the arched member.

Applicant believes that the closest reference corresponds to U.S. Pat. No. 1,447,189 issued to Simon on Mar. 6, 1923. Simon's patented invention includes a frame assembly (1) with horizontal piece (2) and semi-circular or arcuated pieces (3 and 4), slats (5) with wire framework (10), block (11) and arcuated (actuating) member (19) with the consequently structural exposure. The ends (12 and 13) of framework (10) are mounted to lower arcuated piece (4). However, it differs from the present invention because the distal end of the blinds is actuated with a common link connected to a gear assembly mounted to the center of the distal end. In Simon's, the slats (5) are pivotally mounted to a fixed concentric member (arcuated piece 3) and the distal ends of the blinds are actuated with arcuated members (19) connected to one of the external edges of the distal ends of slats (5), not in the central axis of the pivot point. There is no mechanism for aligning the slats or louvers as in the invention claimed herein.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a louvered arch mechanism where the louvers are remotely actuated and rotated between two extreme positions.

It is another object of this invention to provide a system is volumetrically efficient and thus capable of being mounted with minimum requirements.

It is still another object of the present invention to provide a system that imparts the rotational movement to the clips centrally mounted to the distal ends of the louvers at the center allowing the mechanism to be hidden.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 3 illustrates a broken, detailed and partial view of one of the louvers used in the embodiment shown in previous figures for louvered arch mechanism.

FIG. 4 is a cross-sectional view taken along line 4—4 in FIG. 3.

FIG. 5 shows an exploded view of the sprocket assembly used for the embodiment represented in FIGS. 1 through 4.

DETAILED DESCRIPTION OF THE PREFERRED EMBODIMENT

Figure 1:
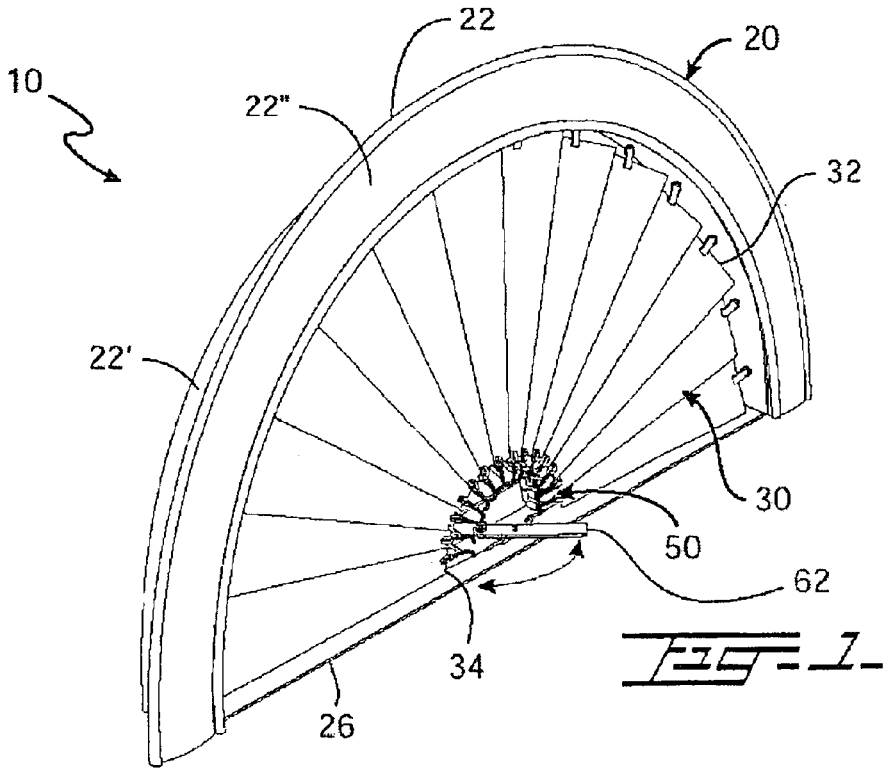
FIG. 1 represents an isometric view of one of the preferred embodiments for the louvered arch mechanism, object of the present invention.

Referring now to the drawings, where the present invention is generally referred to with numeral 10, it can be observed that it basically includes arched frame assembly 20, blinds or louver members 30, actuating mechanism assembly 40 and tensioning assembly 50.

Figure 2:
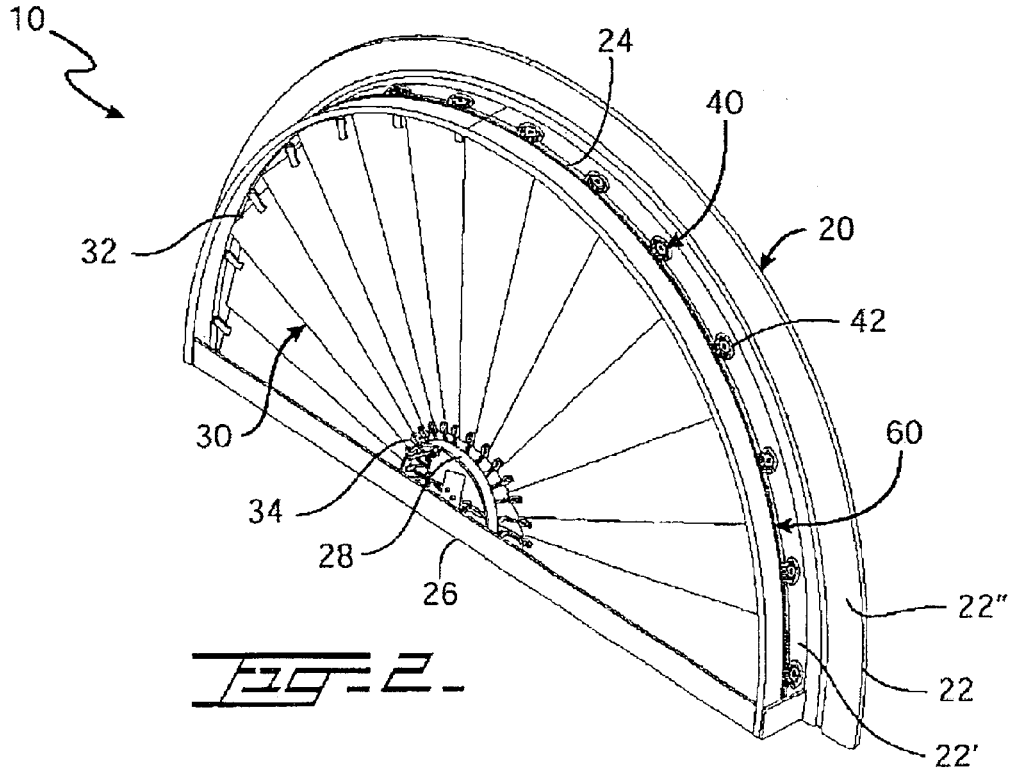
FIG. 2 shows the louvered arch mechanism shown in FIG. 1, seen from the other side.

Frame assembly 20 includes arched frame member 22 and straight frame member 26. Member 22 extends from one end of member 26 and joins the other end of member 26. Arched anchorage member 28 is centrally mounted on member 26, as seen in FIG. 2, extending at a parallel and spaced apart relationship with respect to member 22 and also in a substantially concentric relationship thereto. Arched back member 22' serves as support for decoration arched cover member 22". Member 22' is perpendicularly mounted to member 22". Member 22' includes a number of recessed through openings 23.

Blinds or louver members 30 include distal end 32 with through opening 33 at a predetermined distance from end 32 and proximal end 34 with through opening 35 at a predetermined distance from end 34, as seen in FIGS. 3 and 4. Blinds or louver members 30 have a substantially truncated triangular shape and preferably are made out of a rigid material.

In the preferred embodiment, tensioning assembly 50 includes several anchoring members 54 mounted to member 28. Flexible member 52 is preferably a chain, hooked at end 55 to opening 35 through hook 53. Anchoring member 54 engages flexible member 52 between ends 55 and 55' urging it away from member 22' and keeping it tense.

In the preferred embodiment, actuating mechanism assembly 40 includes sprocket assembly 40', pin members 48, chain 60, cable 61, hook members 64 and actuating lever 62, as seen in FIGS. 3, 4 and 5. Sprocket assembly 40' has upper and lower ends and includes sprocket member 42 with built-in washer 41 rigidly mounted to the lower end of sprocket assembly 40', as best seen in FIG. 5. Built-in washer 41 rests on washer member 45 and the latter rests on counterbore shoulder 25 permitting sprocket assembly 40' to slidably rotate. Built-in washer 41 and washer member 45 coact with a relatively small friction coefficient. Washer member 45 includes perpendicularly and peripherally mounted tongue 45' that is positioned inside channel 24. Sprocket member 42 includes central through opening 43 with internal sawtooth formation 44 formed adjacent to internal wall 47 and extending approximately to half the height of sprocket member 42. Pin member 48 includes headed end 49, which includes circular surface 49'. The underside of headed end 49 includes sawtooth skirt 51 that extends perpendicularly from surface 49'. End 48' of pin member 48 is rigidly mounted to louver clip member 46. Clip member 46 has legs 38 and 38' extending parallel to each other. Leg 38 includes internal hook member 46'. End 48' has cooperative dimensions to be received within opening 43 and internal sawtooth formation 44 mesh with internal sawtooth skirt 51 so that rotating sprocket member 42 transmits the movement to sawtooth skirt 51.

Chain 60 is of the ball chain type, preferably. Chain 60 is housed within channel 24 on the outer surface of arched back member 22', as best seen in FIG. 2. Chain 60 is preferably actuated by a user through actuating lever 62 and cable 61, as seen in FIGS. 1 and 3. Chain 60 slides inside channel 24 and meshes with sprocket 42 at a point where channel 24 passes tangentially next to recessed through opening 23. Tongue 45' provides a hard surface to links 66 causing it to press against sprocket member 42. Moving chain 60 causes sprocket 42 to rotate and thus louver members 30 rotate.

Recessed through openings 23 includes counterbore shoulder 25. In the preferred embodiment, washer member 45 rests on counterbore shoulder 25 avoiding the frictional forces of sprocket assembly 40' and chain 60 against counterbore shoulder 25. Ball links 66 of chain 60 cooperatively coact with sprocket member 42 to convert the translational movement into rotational movement. Sprocket assembly 40' transmits the rotational movement to pin member 48 and clip 46 causing blind or louver member 30 to rotate.

By maintaining blinds or louver members 30 taut at ends 34, ends 32 are moved in tandem with chain 60. Different types of chain can be used provided that they co-act with sprocket 42. Mechanism 40 is actuated by a user, preferably through the use of actuating lever 62 located at the center of lower frame member 26, as seen in FIG. 1. Control lever 62 is connected to chain 60 through hook member 64 and cable 61. The system is volumetrically efficient and thus capable of being mounted with minimum space requirements.

Figure 6:
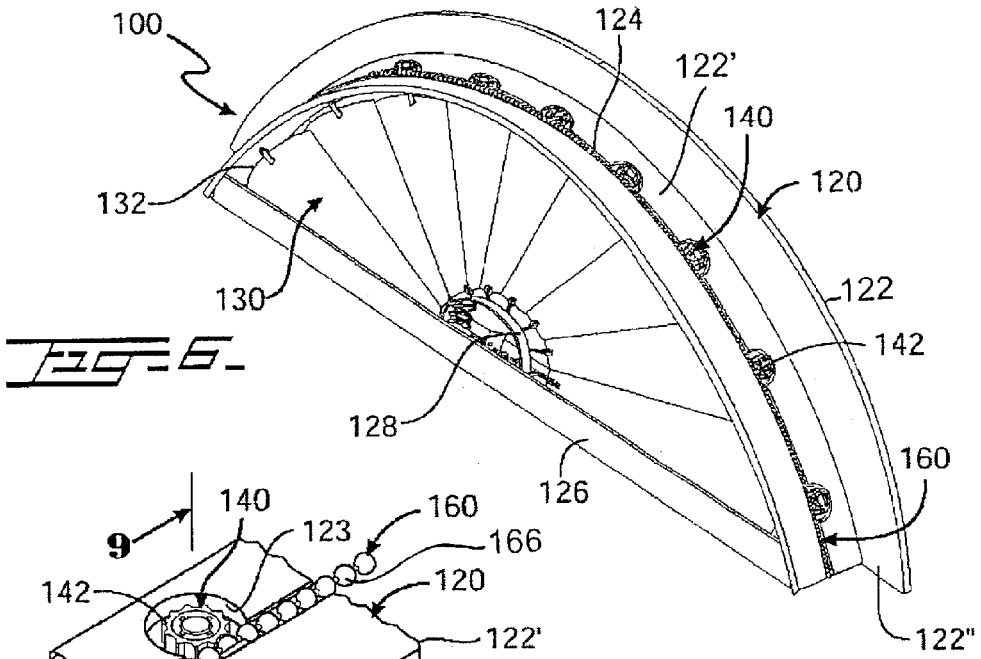
FIG. 6 represents an isometric view of another preferred embodiment for the louvered arch mechanism object of this application.

Another embodiment for the present invention 100 is represented in FIGS. 6; 7; 8; 9; 11 and 12, for a louvered arch mechanism. This embodiment can be used for perfect of imperfect arches. By imperfect or non-perfect arch is meant an arch with a center that falls beyond the straight frame member. Louvered arch mechanism 100 includes arched frame assembly 120, blinds or louver members 130, actuating mechanism assembly 140 and tensioning assembly 150. Imperfect blind assemblies 120 are aesthetically desired when there is no sufficient ceiling height or it is merely desired by a user. The problem with these designs is that louver holding pin member 148 is kept at an angle with respect to arched back frame member 122'.

Figure 9:
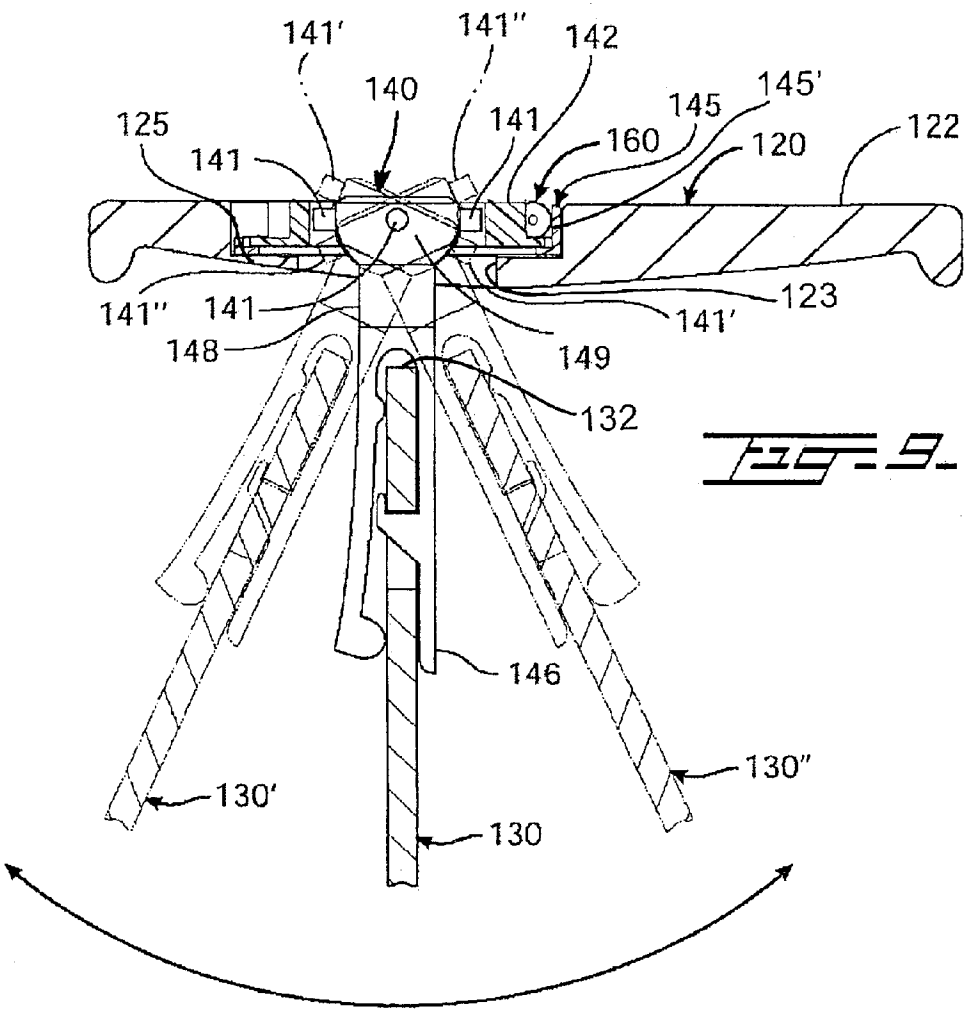
FIG. 9 is a cross-sectional view taken along line 9—9 in FIG. 7.

Arched frame assembly 120 includes arched frame member 122 and straight frame member 126. Member 122 extends from one end of member 126 and joins the other end of member 126. Arched anchorage member 128 is centrally mounted on member 126 extending at a parallel and spaced apart relationship with respect to arched frame member 122. Arched frame member 122 includes arched back frame member 122', arched cover frame member 122", channel 124 on the outer surface of arched back frame member 122', and recessed through openings 123 through which louver holding pin member 148 passes, as shown in FIG. 9. Clip member 146 is mounted to end 132 of louver member 130. Pin member 148 is rigidly mounted to clip member 146 and the former has cooperative dimensions to pass recessed through opening 123 to engage with sprocket member 142.

Figure 7:
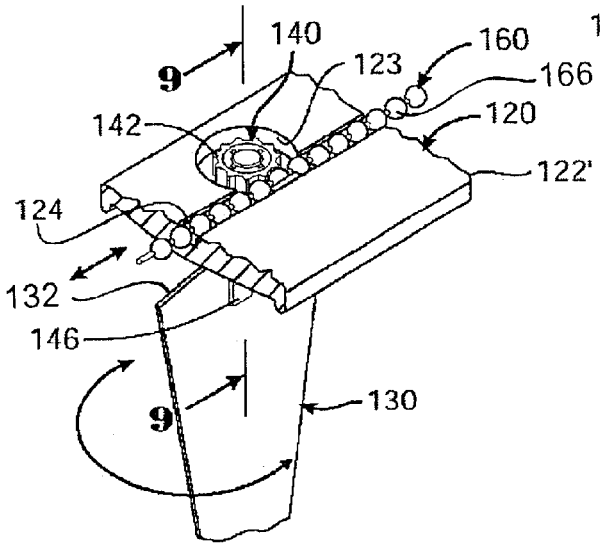
FIG. 7 illustrates a broken detail view of the embodiment shown in FIG. 6 for louvered arch mechanism with non-perfect or imperfect arch.
Figure 7:
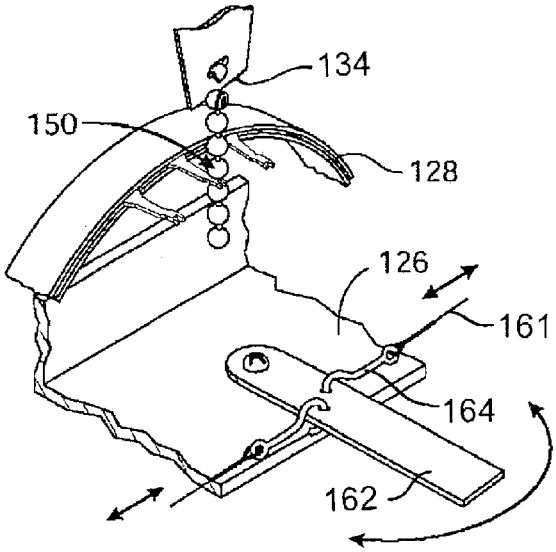
Figure 8:
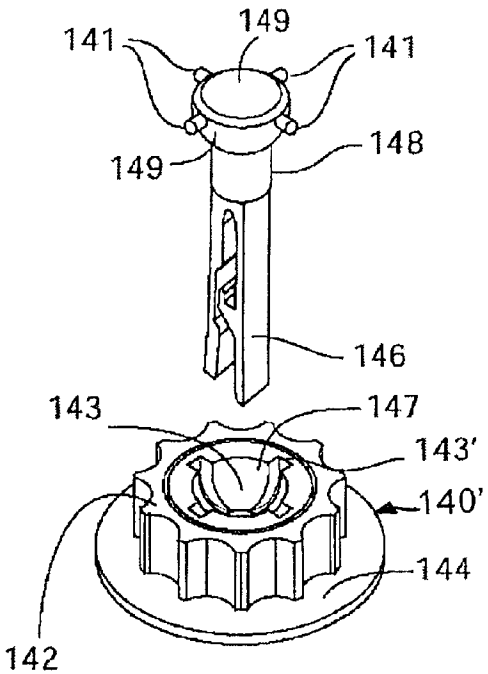
FIG. 8 shows an exploded view of the sprocket assembly used for the embodiment represented in FIGS. 6 and 7.
Figure 11:
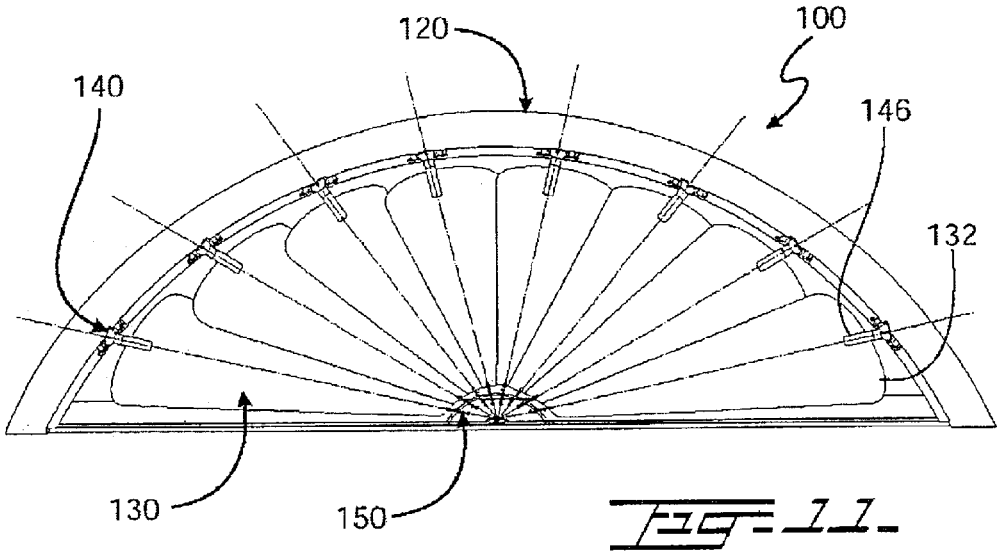
FIG. 11 represent a schematic view of the embodiment represented in FIGS. 6 and 7 for mechanisms with non-perfect or imperfect arch.
Figure 12:
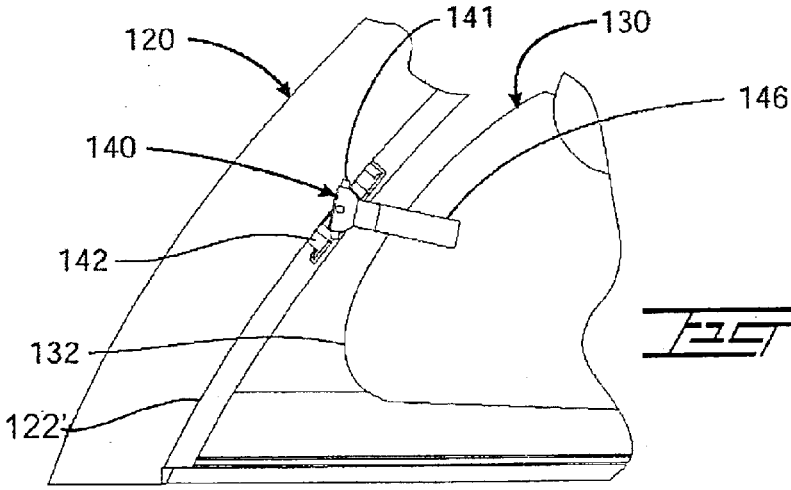
FIG. 12 shows an enlarged detail view of the sprocket assembly for the embodiment represented in FIGS. 6 and 7 for louvered arch mechanisms with non-perfect or imperfect arch.

Actuating mechanism assembly 140, includes sprocket assembly 140', louver holding pin member 148, chain 160, cable 161, hook members 164 and actuating lever 162, as seen in FIGS. 6 and 7. Sprocket assembly 140' can be used for the embodiment represented in FIGS. 6; 7; 8; 9; 11 and 12, involving non-perfect (or imperfect) arch frames (where the radius of curvature is different at different points of the arch). The difficulty with these arch frames is that, for most blinds or louver members 130, counterbore shoulder 125 is not in a perpendicular disposition with respect to the longitudinal axle of pin member 148, as best seen in FIGS. 11 and 12. Blinds or louver members 130 include distal end 132 and proximal end 134. Sprocket assembly 140' has upper and lower ends and includes sprocket member 142 with built-in washer 144 rigidly mounted to the lower end of sprocket assembly 140', headed end 149 rigidly mounted to louver holding pin member 148 and clip member 146. Headed end 149 has a substantially hemispherical shape with flat upper end 149'. Headed end 149 includes radial pin members 141 cooperatively disposed around headed end 149 next to upper end 149'. Sprocket member 142 includes through opening 143 with socket 147 and internal radially-grooves 143' cooperatively disposed to receive pin members 141 therein. Socket 147 has cooperative dimensions to receive headed end 149.

As shown in FIG. 9, actuating mechanism assembly 140 and louver members 130 move between two extreme positions as shown in phantom with 130' and 130". Extreme positions 141' and 141", respectively, for pin members 141 that move along internal grooves 143'.

Blinds or louver members 130 have different dimensions being the longest ones the ones on the sides and the shorter ones the ones in the center, as seen in FIGS. 6 and 11.

Chain 160 is housed within channel 124 tangent to opening 123. Built-in washer 144 rests on washer member 145. Washer member 145 rests in counterbore shoulder 125 avoiding the frictional forces of sprocket assembly 140' and chain 160 against counterbore shoulder 125. Ball links 166 of chain 160 coacts with sprocket member 142 causing the latter to rotate. Sprocket member 142 transmits the rotational movement to pin member 148 and clip member 146 causing louver members 130 to rotate.

Figure 10:
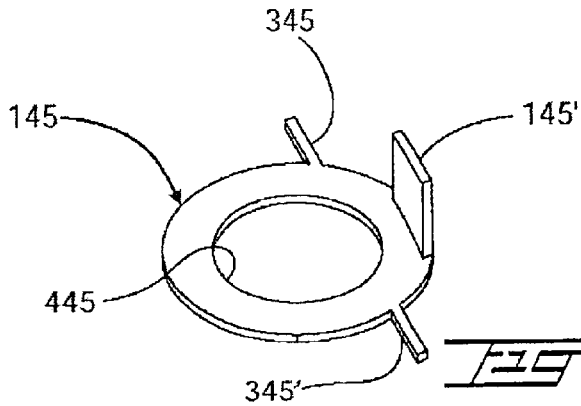
FIG. 10 represent an isometric view of the washer member used in the present invention to avoid the frictional forces of the actuating mechanism assembly and the chain against the shoulder.

Washer member 145, like washer member 45, includes perpendicularly mounted tongue 145', arms 345 and 345' and central through opening 445, as seen in FIG. 10. Washer member 145 rests on counterbore shoulder 125 and arms 345 and 345' are positioned inside channel 124 adjacent to recessed through opening 123. Arms 345 and 345' prevent the rotation of washer member 145 with the movement of actuating mechanism assembly 140 and chain 160. Tongue 245 is positioned adjacent to the farthest wall of channel 124 providing a hard surface against which ball links 166 coact with sprocket assembly 140', as best seen in FIGS. 7 and 9 (and FIGS. 3 and 4 for washer member 45).

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A louvered arch mechanism, comprising:

A) an arched frame assembly including a straight member with first and second ends, and an arched frame member extending from said first end to said second end, and further including an arched anchorage member centrally mounted to said straight member at a separate and spaced apart relationship with respect to said arched frame member;

B) a plurality of louver members each having third and fourth ends being rotably mounted between said arched frame member and said arched anchorage member;

C) tensioning means for keeping said louver members taut;

D) means for actuating said louver members including a plurality of sprocket means rotably mounted on said arched frame member and said sprocket means having upper and lower ends and including a central opening with an internal sawtooth formation and further including built-in washer rigidly mounted to said lower end; and E) a corresponding plurality of louver clip members removably mounted centrally at said third ends and each having a pin member with a headed end having a sawtooth skirt that cooperatively engages with said internal sawtooth formation to transmit the rotational force imparted by said sprocket means.

2. The louvered arch mechanism set forth in claim 1 wherein said arched frame member includes a channel that extends longitudinally thereon and a plurality of recessed through openings each having a counterbore shoulder partially overlapping said channel and said recessed through openings having cooperative dimensions to partially allow said louver clip members to go through and further including a plurality of washers and said counterbore shoulder rotatably supports one of said washers which in turn support said built-in washer of said sprocket means, and said means for actuating said louver members includes a chain with ball links that is kept within said channel and coacts with said sprocket means to transmit the translational movement of said chain to said sprocket means.

3. The louvered arch mechanism set forth in claim 2 wherein said means for actuating said louver members includes a washer member with cooperative dimensions to be receivable within said counterbore shoulder and being sandwiched between said counterbore shoulder and said sprocket means thereby facilitating the rotation of the latter.

4. The louvered arch mechanism set forth in claim 3 wherein said washer member includes a tongue tangentially and perpendicularly mounted thereon and being positioned over said channel to coact with said ball links to provide a hard surface to ensure engagement of said ball links with said sprocket means.

5. The louvered arch mechanism set forth in claim 4 wherein said means for actuating said louver members include an actuating lever mounted to said straight member and cable means connected to said actuating lever and to said chain.

6. A louvered arch mechanism, comprising:

A) an arched frame assembly including a straight member with first and second ends, and an arched frame member extending from said first end to said second end, and further including an arched anchorage member centrally mounted to said straight member at a separate and spaced apart relationship with respect to said arched frame member;

B) a plurality of louver members each having third and fourth ends being rotably mounted between said arched frame member and said arched anchorage member;

C) tensioning means for keeping said louver members taut;

D) means for actuating said louver members including a plurality of sprocket means rotably mounted on said arched frame member and said sprocket means having upper and lower ends with a built-in washer rigidly mounted to said lower end and including a central socket with a through opening having a plurality of internal radially extending grooves that extend longitudinally along said socket; and E) a corresponding plurality of louver clip members removably mounted centrally at said third ends and each having a pin member with a headed end having a plurality of radially extending pin members cooperatively receivable within said grooves to transmit the rotational force imparted by said sprocket means.

7. The louvered arch mechanism set forth in claim 6 wherein said arched frame member includes a channel that extends longitudinally thereon and a plurality of recessed through openings each having a counterbore shoulder partially overlapping said channel and said recessed through openings having cooperative dimensions partially allow said louver clip members to go through and said counterbore shoulder rotatably supports said headed end of said pin member, and said means for actuating said louver members includes a chain with ball links that is kept within said channel and coacts with said sprocket means to transmit the translational movement of said chain to said sprocket means.

8. The louvered arch mechanism set forth in claim 7 wherein said means for actuating said louver members includes a washer member with cooperative dimensions to be receivable within said counterbore shoulder and being sandwiched between said counterbore shoulder and said sprocket means thereby facilitating the rotation of the latter.

9. The louvered arch mechanism set forth in claim 8 wherein said washer member includes a tongue tangentially and perpendicularly mounted thereon and being positioned over said channel to coact with said ball links to provide a hard surface to ensure engagement of said ball links with said sprocket means.

10. The louvered arch mechanism set forth in claim 9 wherein said means for actuating said louver members include an actuating lever mounted to said straight member and cable means connected to said actuating lever and to said chain.

* * * * *